US011992046B2

(12) United States Patent
Qiu et al.

(10) Patent No.: US 11,992,046 B2
(45) Date of Patent: May 28, 2024

(54) CARTRIDGE AND ELECTRONIC CIGARETTE

(71) Applicant: CHANGZHOU PATENT ELECTRONIC TECHNOLOGY CO., LTD, Changzhou (CN)

(72) Inventors: Weihua Qiu, Jiangsu (CN); Shanhui Tan, Jiangsu (CN)

(73) Assignee: CHANGZHOU PATENT ELECTRONIC TECHNOLOGY CO., LTD, Changzhou (CN)

( * ) Notice: Subject to any disclaimer, the term of this patent is extended or adjusted under 35 U.S.C. 154(b) by 542 days.

(21) Appl. No.: 17/239,677

(22) Filed: Apr. 25, 2021

(65) Prior Publication Data

US 2021/0244093 A1 Aug. 12, 2021

Related U.S. Application Data

(63) Continuation-in-part of application No. PCT/CN2019/110694, filed on Oct. 12, 2019.

(30) Foreign Application Priority Data

Oct. 24, 2018 (CN) ..... 201821733709.2

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/51* (2020.01)

(58) Field of Classification Search
None
See application file for complete search history.

(56) References Cited

U.S. PATENT DOCUMENTS

2014/0334804 A1* 11/2014 Choi ..... A24F 40/485 392/404
2018/0177240 A1* 6/2018 Duque ..... A24F 40/44
2019/0297948 A1 10/2019 Clemens et al.

FOREIGN PATENT DOCUMENTS

CN 203168030 U 9/2013
CN 203575656 U 5/2014
(Continued)

OTHER PUBLICATIONS

Communication pursuant to Article 94(3) EPC of EP application No. 19875087.9 dated Apr. 6, 2023.
(Continued)

*Primary Examiner* — Tho D Ta
(74) *Attorney, Agent, or Firm* — Andrew C. Cheng

(57) ABSTRACT

A cartridge includes a liquid storage chamber and an atomizing device. The atomizing device includes an atomizing base and a liquid absorbing member installed in the atomizing base. The atomizing base is provided with an atomizing chamber therein. The atomizing base is made of an elastic material. The atomizing base is provided with a through hole. The liquid absorbing member extends through the through hole, and the inner wall of the through hole closely abuts against the outer wall of the liquid absorbing member to isolate the liquid storage chamber from the atomizing chamber. No gap causing e-liquid leakage is present between the liquid absorbing member and the through hole, thereby effectively preventing e-liquid leakage, achieving good isolation between e-liquid and vapor, and simplifying the assembly process. An electronic cigarette having the cartridge is also provided.

4 Claims, 4 Drawing Sheets

(51) Int. Cl.
*A24F 40/46* (2020.01)
*A24F 40/51* (2020.01)

(56) References Cited

FOREIGN PATENT DOCUMENTS

| | | | | | |
|---|---|---|---|---|---|
| CN | 205106387 | U | | 3/2016 | |
| CN | 105876869 | A | | 8/2016 | |
| CN | 206079029 | U | | 4/2017 | |
| CN | 206433763 | U | | 8/2017 | |
| CN | 209346090 | U | | 9/2019 | |
| EP | 3292775 | A1 | | 3/2018 | |
| KR | 20120098343 | A | * | 9/2012 | |
| WO | WO-2016154797 | A1 | * | 10/2016 | ..... A24F 47/00 |
| WO | WO-2016154895 | A1 | * | 10/2016 | ..... A24F 47/00 |
| WO | WO-2017143865 | A1 | * | 8/2017 | ..... A24B 15/167 |
| WO | WO-2017185051 | A1 | * | 10/2017 | ..... A24F 40/30 |
| WO | 2018050030 | A1 | | 3/2018 | |

OTHER PUBLICATIONS

International Search Report of PCT Patent Application No. PCT/CN2019/110694 dated Jan. 21, 2020.
The extended European search report of EP application No. 19875087.9 dated Nov. 7, 2022.

* cited by examiner

CARTRIDGE AND ELECTRONIC CIGARETTE

CROSS-REFERENCE TO RELATED APPLICATIONS

This application is a continuation-in-part of International patent application No. PCT/CN2019/110694, filed on Oct. 12, 2019, entitled "cartridge and electronic cigarette", which claims priority to Chinese patent application No. 201821733709.2, filed on Oct. 24, 2018. All of the aforementioned patent applications are hereby incorporated by reference in their entireties.

TECHNICAL FIELD

The present disclosure relates to the technical field of simulated smoking, and more particularly, relates to a cartridge and an electronic cigarette having the cartridge.

BACKGROUND

Electronic cigarettes are electronic products that imitate cigarettes and have similar smoke, taste and feel to cigarettes. Atomizer is an important part of electronic cigarette, the liquid storage chamber and the airflow passage of the existing atomizer are in communication with each other. In the case of vibration, temperature or pressure changes, the e-liquid in the liquid storage chamber may excessively enter the airflow passage through the liquid guiding rope or the gap between the liquid guiding rope and the airflow passage, and excessive e-liquid flows along the airflow passage towards the mouthpiece or the electrode, causing e-liquid leakage.

SUMMARY

In view of the above, the present disclosure provides a cartridge to solve the above-mentioned problems.

The technical solutions involved in the present disclosure are as follow.

A cartridge includes a liquid storage chamber and an atomizing device. The atomizing device includes an atomizing base and a liquid absorbing member installed in the atomizing base. The atomizing base is provided with an atomizing chamber therein. The atomizing base is made of an elastic material. The atomizing base is provided with a through hole. The liquid absorbing member extends through the through hole, and the inner wall of the through hole closely abuts against the outer wall of the liquid absorbing member to isolate the liquid storage chamber from the atomizing chamber.

Further, the through hole is provided in pairs through a peripheral wall of the atomizing base, the number of the liquid absorbing member is the same as the number of the pairs of the through holes.

Further, the atomizing device further includes a heating member, and the heating member is wound around an outer peripheral surface of the liquid absorbing member.

Further, the liquid absorbing member is made of a hard material.

Further, the liquid absorbing member is a porous ceramic rod, and the porous ceramic rod is a hollow rod or a solid rod.

Further, the atomizing device further includes two electrical conductors and a bottom cover. The two electrical conductors are spaced apart and fixed at the bottom of the atomizing base through the bottom cover. The two electrical conductors are electrically connected to two ends of the heating member, respectively.

An electronic cigarette includes a main body and a cartridge as mentioned above. The atomizing base and a vent tube are mounted in the cartridge. The bottom end of the cartridge is connected to the bottom end of the atomizing base. A mouthpiece is provided at the top of the cartridge. One end of the vent tube is in communication with the mouthpiece, and the other end of the vent tube is in communication with the atomizing base. A fixing seat is provided in the main body, and two magnets are fixedly connected to the fixing seat. The cartridge is mounted to the main body, and the two electrical conductors are respectively attracted by the two magnets.

Further, the main body includes a control board and a sensor. A mounting cavity is formed at the bottom end of the fixing seat. The sensor is mounted in the mounting cavity and electrically connected to the control board.

Further, the main body further includes two probes. The two probes are electrically connected to power output terminals of the control board, and the two probes are respectively electrically connected with the two electrical conductors.

Further, an airflow passage is defined in the fixing seat and is correspondingly located above the sensor, and the airflow passage is in communication with the atomizing chamber.

In summary, the e-liquid generally leaks from the liquid inlet hole or the installation gap of the atomizing base in the existing electronic cigarettes. However, the atomizing base in the cartridge of the present disclosure is made of an elastic material, the atomizing base is provided with through holes, the liquid absorbing member extends through the through holes, and the liquid absorbing member can be tightly fitted within the through holes of the atomizing base. That is, the inner peripheral wall of the through holes can closely abut against the outer peripheral surface of the two ends of the liquid absorbing member, so that no gap causing e-liquid leakage exists between the liquid absorbing member and the through holes, thereby effectively avoiding e-liquid leakage, achieving good isolation between e-liquid and vapor, and simplifying the assembly process. The electronic cigarette equipped with the above cartridge has the advantages of avoiding e-liquid leakage, good isolation between e-liquid and vapor, and simple assembly.

DETAILED DESCRIPTION OF PREFERRED EMBODIMENTS

The technical solution of the present disclosure will be described clearly and completely with reference to the drawings and the embodiments. It should be understood that the specific embodiments described herein are only used to explain the present disclosure and are not used to limit the protection scope of the present disclosure.

Figure 1:
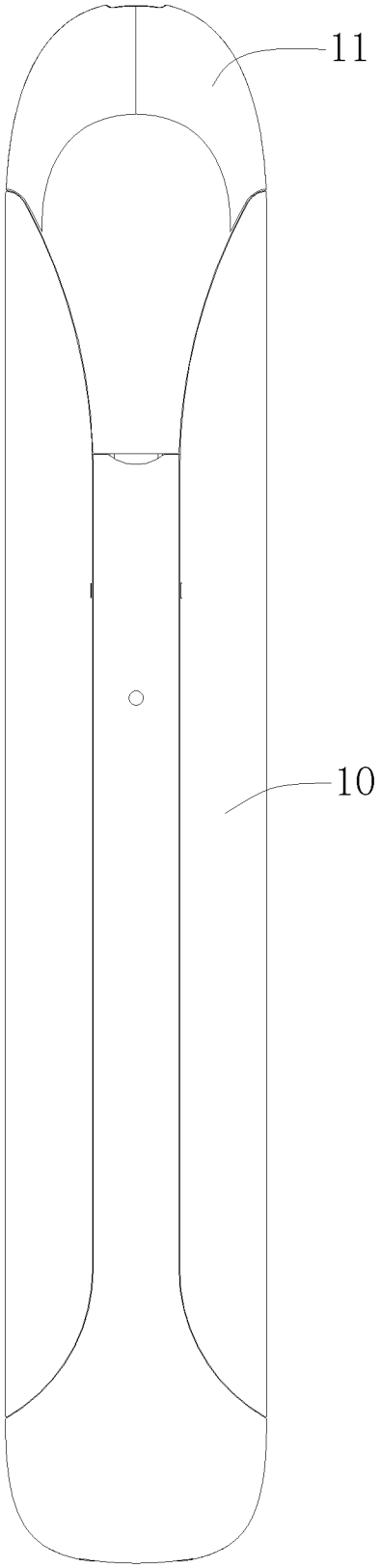
FIG. 1 is a front view of an electronic cigarette equipped with a cartridge of the present disclosure.
Figure 2:
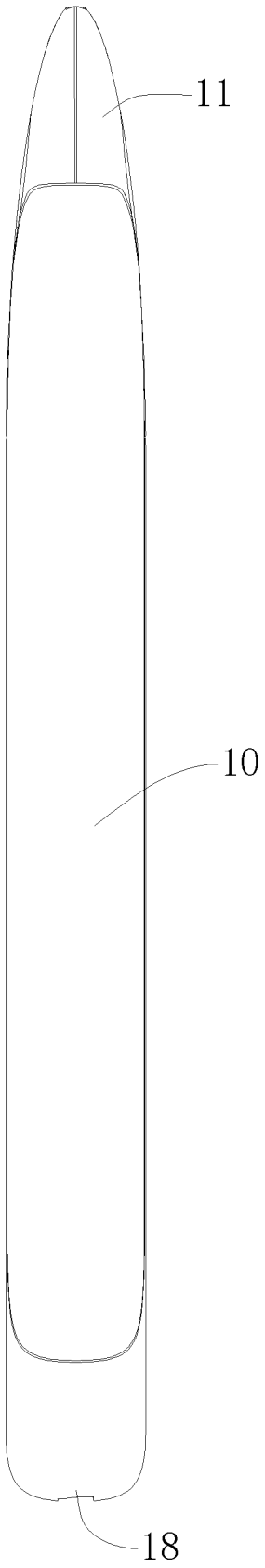
FIG. 2 is a side view of an electronic cigarette equipped with a cartridge of the present disclosure.
Figure 3:
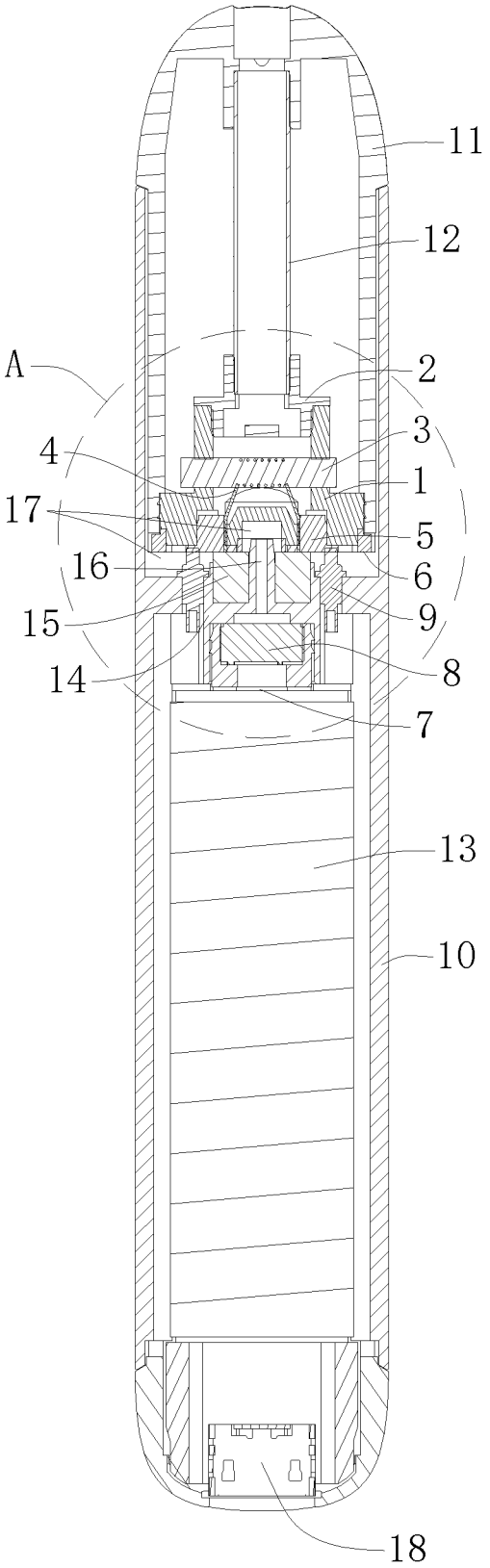
FIG. 3 is a cross-sectional view of an electronic cigarette equipped with a cartridge of the present disclosure.
Figure 4:
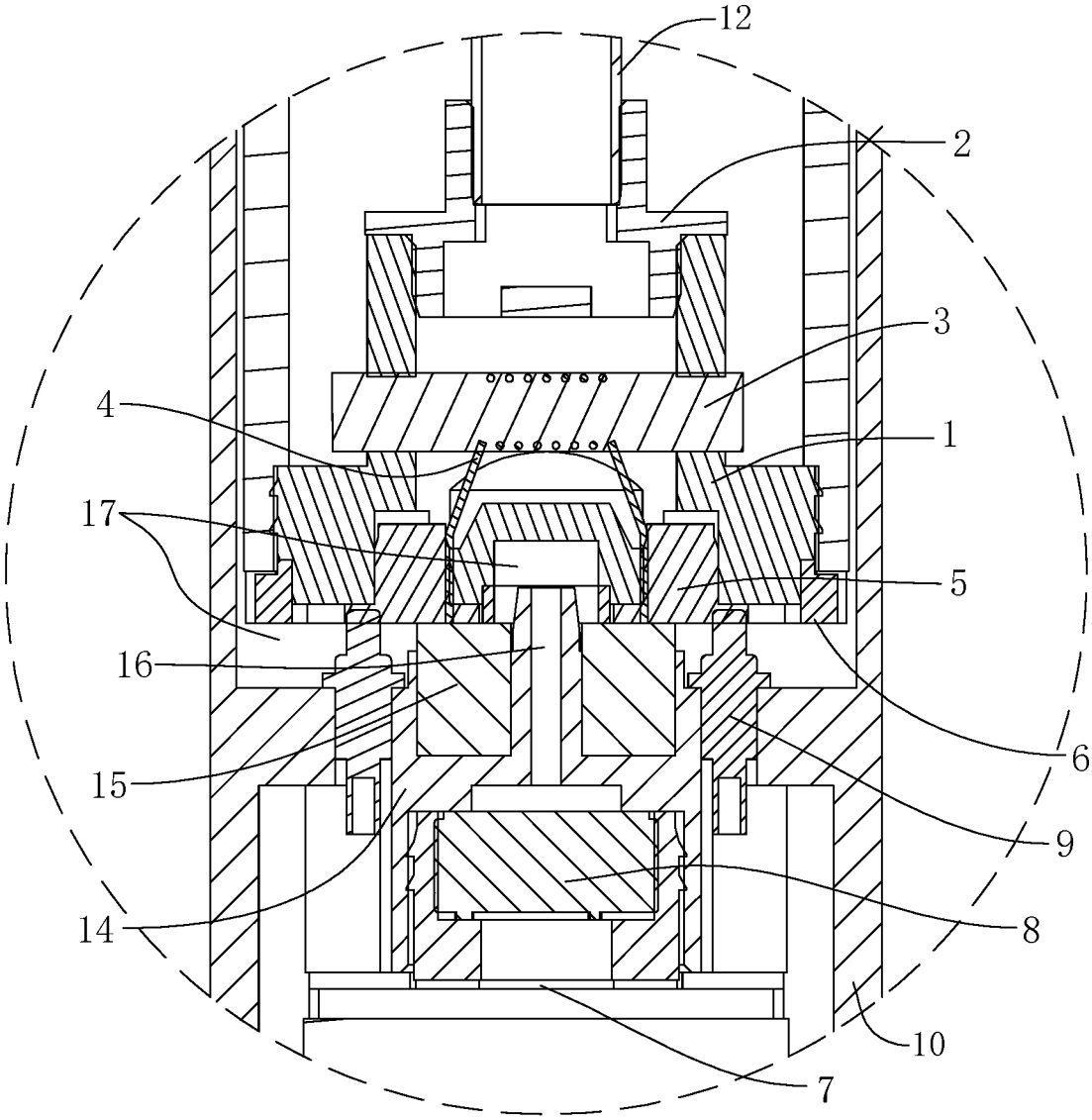
FIG. 4 is an enlarged view of the portion Ain FIG. 3.

Please refer to FIGS. 1 to 4, the present disclosure provides a cartridge. The cartridge includes a liquid storage chamber and an atomizing device. The atomizing device includes an atomizing base 1, an atomizing cover 2, and a liquid absorbing member 3 installed in the atomizing base 1. The atomizing base 1 defines an atomizing chamber therein. The atomizing base 1 is made of an elastic material, such as silicone, rubber, or the like. The atomizing cover 2 is tightly mounted to the top of the atomizing base 1, so that the atomizing cover 2 cooperates with the atomizing base 1 to form the atomizing chamber therebetween. Two through holes are oppositely provided through the peripheral wall of the atomizing base 1, and two ends of the liquid absorbing member 3 are tightly inserted into the two through holes, respectively. In another embodiment, the atomizing base 1 may be made of a high-temperature resistant elastic material to avoid the irritating smell caused by the high temperature of the atomization.

Due to the elasticity of the atomizing base 1, the liquid absorbing member 3 can be tightly fitted within the through holes of the atomizing base 1, and the inner peripheral wall of the through holes can closely abut against the outer peripheral surface of the two ends of the liquid absorbing member 3, so that no gap causing e-liquid leakage exists between the liquid absorbing member 3 and the through holes, thereby effectively avoiding e-liquid leakage, achieving a good heat insulation effect, and simplifying the assembly process. In another embodiment, in order to ensure a tight fit, the liquid absorbing member 3 is made of a hard material, for example, the liquid absorbing member 3 is a porous ceramic rod. The ceramic rod is porous and can absorb e-liquid, and its hardness is high, so it is more convenient to install. Otherwise, when the liquid absorbing member 3 is also a soft material, it will increase the difficulty of assembly.

The atomizing device further includes a heating member 4. The heating member 4 is wound around the outer peripheral surface of the liquid absorbing member 3. Two ends of the heating member 4 are respectively connected to power output terminals of the electronic cigarette.

The liquid absorbing member 3 may be made of a hard material, such as a porous ceramic rod. When the liquid absorbing member 3 is a porous ceramic rod, it can be a hollow rod or a solid rod. When the liquid absorbing member 3 is a hollow rod, it can increase the contact area between the e-liquid and the liquid absorbing member 3, and provide e-liquid to the heating member 4 more quickly. Preferably, the heating member 4 is made of PTC alloy wire. The heating member 4 may also be pre-built in ceramic material and then integrally formed by sintering.

The atomizing device further includes two electrical conductors 5 and a bottom cover 6. The two electrical conductors 5 are spaced apart and fixed at the bottom of the atomizing base 1 through the bottom cover 6. The bottom cover 6 is an electrical insulator. The two electrical conductors 5 are electrically connected to two ends of the heating member 4, respectively.

The atomizing device further includes a control board 7, a sensor 8 and two probes 9. The control board 7 is electrically connected to power terminals of the electronic cigarette. The sensor 8 is electrically connected to the control board 7. The two probes 9 are electrically connected to power output terminals of the control board 7. The two probes 9 are electrically connected to the two electrical conductors 5, respectively. Specifically, the top end of the probe 9 is connected to the bottom end of the electrical conductor 5, and the bottom end of the probe 9 is fixed to the control board 7. The sensor 8 is used to detect the changes of airflow so as to determine whether the power is supplied to the atomization circuit using the two probes 9.

The present disclosure further provides an electronic cigarette. The electronic cigarette includes a main body 10 and a cartridge 11. The atomizing base 1 and a vent tube 12 are mounted in the cartridge 11. The bottom end of the cartridge 11 is fixedly connected to the bottom end of the atomizing base 1. The liquid storage chamber is formed between the cartridge 11 and the atomizing base 1. A mouthpiece is provided at the top of the cartridge 11. One end of the vent tube 12 is in communication with the mouthpiece, and the other end of the vent tube 12 is in communication with the top end of the atomizing cover 2. A fixing seat 14 is provided in the main body 10, and the fixing seat 14 divides the interior of the main body 10 into upper and lower spaces. Two magnets 15 are fixedly connected to the fixing seat 14. The two electrical conductors 5 are made of stainless iron or stainless steel. The cartridge 11 is detachably inserted into the main body 10, and the two electrical conductors 5 are respectively attracted by the two magnets 15. A mounting cavity is formed at the bottom end of the fixing seat 14 (that is, the opposite end with respect to the magnets 15), and the sensor 8 is mounted in the mounting cavity. An airflow passage 16 is defined in the fixing seat 14 and is correspondingly located above the sensor 8. The airflow passage 16 is in communication with the bottom space 17 of the atomizing base 1. The atomizing base 1 is provided with an air inlet hole used for the atomizing chamber to communicate with the bottom space 17. The main body 10 is provided with an air suction hole used for the bottom space 17 to communicate with the outside. The air suction hole may be a gap between the cartridge 11 and the main body 10 after they are installed.

An interface 18 for charging the battery 13 or transmitting data is provided at the bottom end of the main body 10.

When a user sucks the mouthpiece, the sensor 8 detects the changes of the airflow in the bottom space 17, for example, the changes of the flow rate of the airflow or the air pressure. When the range of the changes of the airflow meets the trigger condition, the output electrical current of the battery 13 is supplied to the atomization circuit through the two probes 9, and the heating member 4 heats and atomizes the e-liquid. That is, the heat emitted by the heating member 4 atomizes the e-liquid absorbed in the liquid absorbing member 3. The outside air enters the atomizing chamber from the bottom space 17, the smoke generated by the atomized e-liquid enters the mouth from the atomizing chamber through the vent tube 12, so that the user can experience the feel of smoking.

In summary, the e-liquid generally leaks from the liquid inlet hole or the installation gap of the atomizing base in the existing electronic cigarettes. However, the atomizing base 1 in the cartridge of the present disclosure is made of an elastic material, the atomizing base 1 is provided with through holes, the liquid absorbing member 3 extends through the through holes, and the liquid absorbing member 3 can be tightly fitted within the through holes of the atomizing base 1. That is, the inner peripheral wall of the through holes can closely abut against the outer peripheral surface of the two ends of the liquid absorbing member 3, so that no gap causing e-liquid leakage exists between the liquid absorbing member 3 and the through holes, thereby effectively avoiding e-liquid leakage, achieving good isolation between e-liquid and vapor, and simplifying the assembly process. The electronic cigarette equipped with the above cartridge has the advantages of avoiding e-liquid leakage, good isolation between e-liquid and vapor, and simple assembly.

The above is only the embodiment of the present disclosure, and is not intended to limit the scope of the present disclosure. Any equivalent structure or equivalent process transformation made by using the content of the description of the present disclosure, or directly or indirectly applied in other related technical fields, is also included in the protection scope of the present disclosure.

What is claimed is:

1. An electronic cigarette, comprising:

a main body (10); and a cartridge, comprising:

a liquid storage chamber; and an atomizing device comprising an atomizing base (1) and a liquid absorbing member (3) installed in the atomizing base (1) the atomizing base (1) provided with an atomizing chamber therein;

wherein the atomizing base (1) is made of an elastic material, the atomizing base (1) is provided with a through hole, the liquid absorbing member (3) extends through the through hole, the inner wall of the through hole closely abuts against the outer wall of the liquid absorbing member (3) to isolate the liquid storage chamber from the atomizing chamber;

wherein the main body (10) comprises a control board (7) and a sensor (8), a fixing seat (14) is provided in the main body (10), a mounting cavity is formed at the bottom end of the fixing seat (14), the sensor (8) is mounted in the mounting cavity and electrically connected to the control board (7);

wherein two magnets (15) are fixedly connected to the fixing seat (14), and the two magnets (15) are configured for respectively attracting two electrical conductors (5) mounted in the cartridge (11).

2. The electronic cigarette according to the claim 1, wherein the atomizing base (1) and a vent tube (12) are mounted in the cartridge (11), the bottom end of the cartridge (11) is connected to the bottom end of the atomizing base (1), a mouthpiece is provided at the top of the cartridge (11), one end of the vent tube (12) is in communication with the mouthpiece, the other end of the vent tube (12) is in communication with the atomizing base (1).

3. The electronic cigarette according to the claim 1, wherein the main body (10) further comprises two probes (9), the two probes (9) are electrically connected to power output terminals of the control board (7), the two probes (9) are respectively electrically connected with the two electrical conductors (5) arranged on the cartridge (11).

4. The electronic cigarette according to the claim 1, wherein an airflow passage (16) is defined in the fixing seat (14) and is correspondingly located above the sensor (8), the airflow passage (16) is in communication with the atomizing chamber.

* * * * *